US006003270A

United States Patent [19]

MacIntyre

[11] Patent Number: 6,003,270

[45] Date of Patent: Dec. 21, 1999

[54] VARIABLE RISER SEATING SYSTEM

[76] Inventor: James R. MacIntyre, 1680 Woodglen La., Altadena, Calif. 91001

[21] Appl. No.: 09/061,057

[22] Filed: Apr. 16, 1998

[51] Int. Cl.[6] ..... E04H 3/12

[52] U.S. Cl. ..... 52/10; 52/6; 52/8; 52/9; 52/183

[58] Field of Search ..... 52/6, 7, 8, 9, 10, 52/183

[56] References Cited

U.S. PATENT DOCUMENTS

| | | | |
|---|---|---|---|
| 2,817,121 | 12/1957 | MacKintosh | 52/9 |
| 3,183,558 | 5/1965 | Cronin . | |
| 3,626,438 | 12/1971 | Cornell | 52/183 |
| 3,932,972 | 1/1976 | Rossman | 52/9 X |
| 4,124,657 | 11/1978 | Poulain | 52/183 |
| 4,497,154 | 2/1985 | Johnson | 52/6 X |
| 5,189,854 | 3/1993 | Nebel | 52/183 |
| 5,660,000 | 8/1997 | MacIntyre | 52/6 X |

FOREIGN PATENT DOCUMENTS

| | | | |
|---|---|---|---|
| 2 306 319 | 10/1976 | France . | |
| 2 687 713 | 8/1993 | France . | |
| 220829 | 4/1910 | Germany | 52/6 |
| 424200 | 8/1933 | Germany | 52/6 |
| 3803823 | 8/1989 | Germany | 52/6 |
| 2 153 171 | 6/1990 | Japan . | |
| 4 277 267 | 2/1994 | Japan . | |

*Primary Examiner*—Beth Aubrey
*Assistant Examiner*—Brian E. Glessner
*Attorney, Agent, or Firm*—Watson Cole Grindle Watson, P.L.L.C.

[57] ABSTRACT

A seating system having a plurality of seating sections in which the slope of the understructure thereof can be varied, the treads of the seating sections being pivotable to permit the riser height to vary so as to enable a single seating system to provide varying slopes and sight lines depending on the stadium/arena configuration. The treads are pivotable between low riser and high riser positions by the provision of lever arms movable between angular and upright positions and extending between the treads and the beams for supporting the treads in the high riser position on the upper surface of understructure beams. In the low riser position ends of the treads opposite their pivotal ends are supported on an adjacent tread.

6 Claims, 3 Drawing Sheets

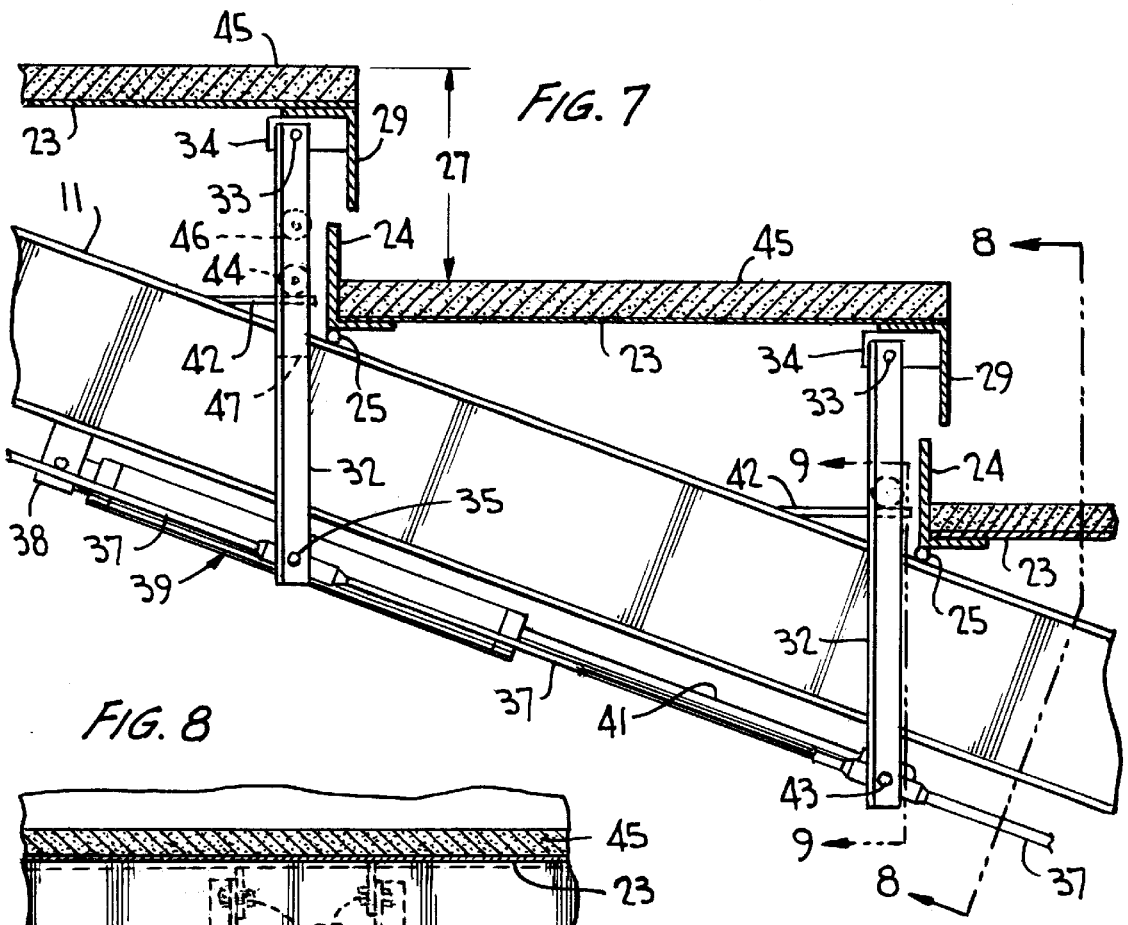
FIG. 7
FIG. 8
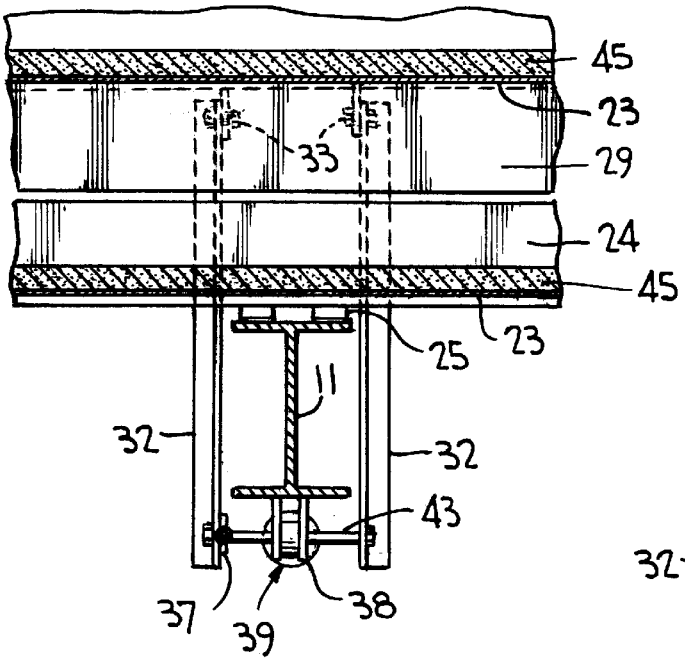
FIG. 9
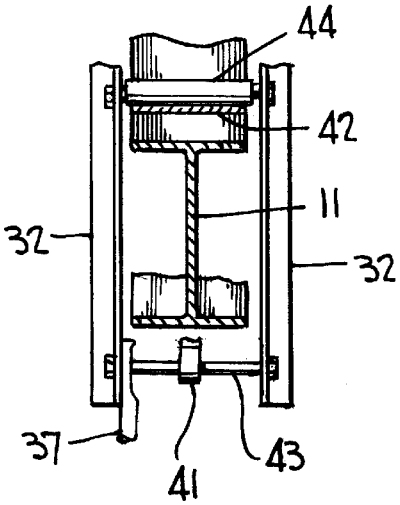

VARIABLE RISER SEATING SYSTEM

BACKGROUND OF THE INVENTION

This invention relates generally to a seating system in which the slope of its understructure is variable to provide variable sight lines for multiple stadium/arena configurations. More particularly the treads of the seating system are pivotable such that the height of the risers are variable between different sloping configurations.

There are a number of known telescopic seating systems having variable risers in which each row of seats is structured as to be independently telescopic for both maintaining a predetermined slope of the seating system and establishing the preferred riser height. For example, Japanese patent 4-277267 discloses in its FIGS. 6 and 7 such a variable riser telescoping platform seating system as does French patent 2687713. Japanese patent 2-153171 discloses a variable sloping seating section with the treads being maintained horizontal.

French patent 2,306,319 discloses a tiered seating system for mobile theaters in which the slope of the understructure beams is varied, and the treads are adjustable as to remain substantially horizontal irrespective of the inclination of the structure.

The known prior art systems are, however, of generally complex structure and require many moving parts which therefore bring into question the reliability and economy of such systems.

SUMMARY OF THE INVENTION

An object of the present invention is to provide a seating system which is non-telescopic but in which the slope of the system can be varied, the treads being pivotable to permit the riser height to vary so as to enable a single seating system to provide varying slopes and sight lines depending on the stadium/arena configuration.

The system according to the invention is structured as to have a variable slope as well as pivotable treads for varying the riser heights to preserve the required sight lines permitting use of a single seating system for multiple seating configurations such as ice hockey and basketball and other sports and entertainment events.

The seating system includes longitudinal support beams adjustable in slope between at least the first angular sloping position and a second steeper angular sloping position. Treads transversely span the beams to support standard arena seats thereon which typically have a folding seat bottom. The treads are pivoted to the beams along one of the forward or rearward ends thereof, and are maintained at a low riser height as forward ends of the treads overlap with and are supported on a transverse support beam provided at the confronting end of an adjacent tread. At the steeper sloping position, lever arms provided for pivoting each tread to their high riser height roll along a bent plate mounted on the longitudinal support beams such that the forward ends of the treads are supported on the bent plates at the upper surfaces of the longitudinal beams.

The lever arms are pivotally interconnected to tie rods and are pivoted by an actuator lying parallel to the longitudinal beams.

Other objects, advantages and novel features of the invention will become more apparent from the following detailed description of the invention when taken in conjunction with the accompanying drawings.

BRIEF DESCRIPTION OF THE DRAWINGS

FIG. 7 is a view similar to FIG. 6 of the seating system in its high riser position;

FIG. 8 is a view taken substantially along the line 8—8 of FIG. 7; and FIG. 9 is a view taken substantially along the line 9—9 of FIG. 6 and of FIG. 7.

DETAILED DESCRIPTION OF THE INVENTION

Figure 1:
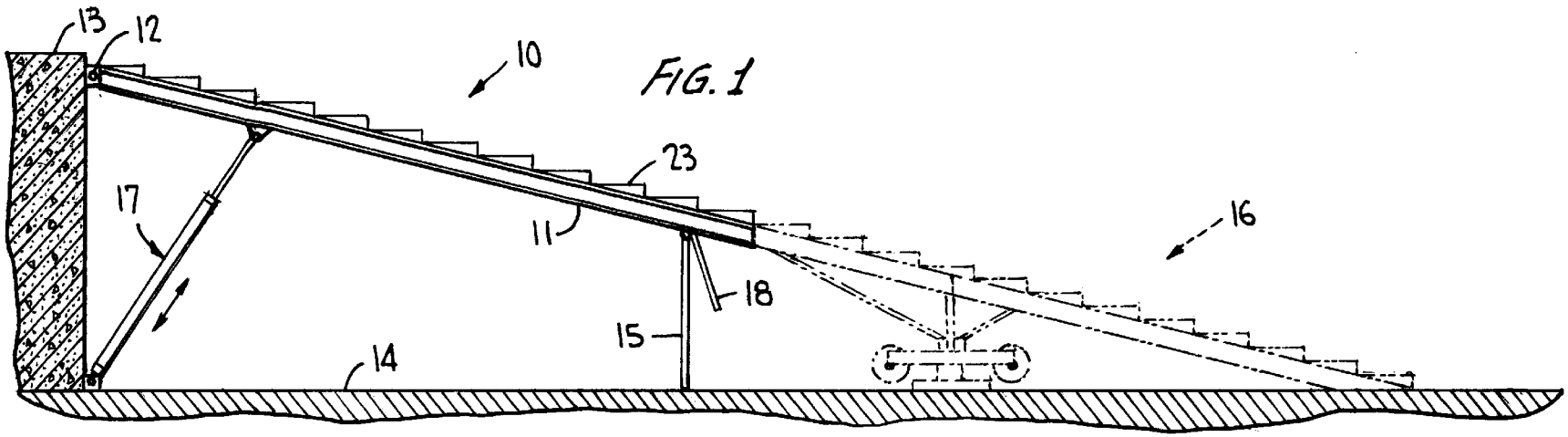
FIG. 1 is a side elevational view of the seating system according to the invention shown in its low riser position, together with a portable seating unit shown in phantom outline and forming no part of the invention.
Figure 2:
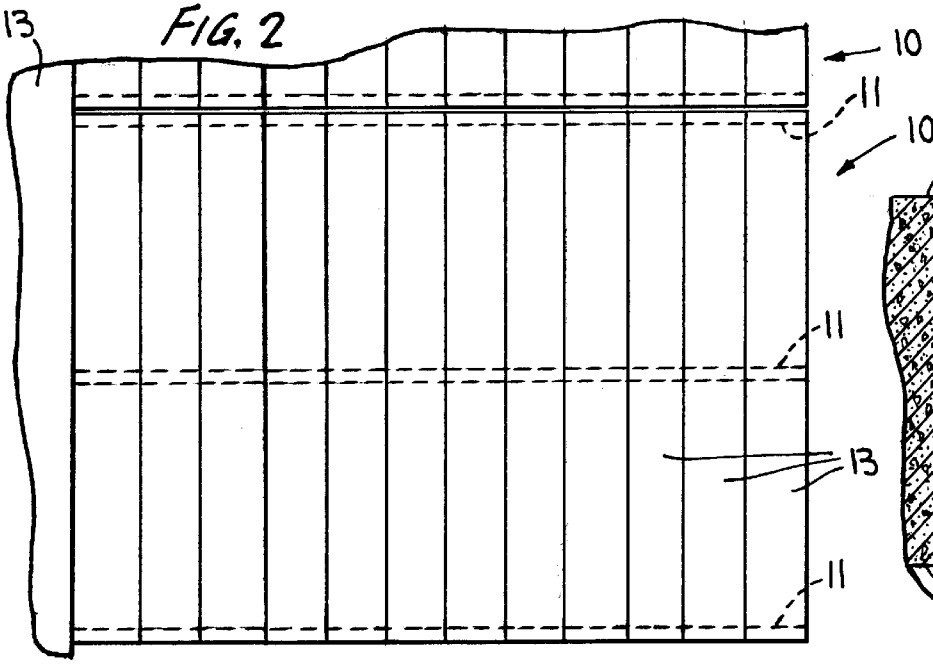
FIG. 2 is a top plan view of the seating system of FIG. 1 according to the invention.

Turning now to the drawings wherein like reference characters refer to like and corresponding parts throughout the several views, a seating section of the seating system according to the invention is generally designated 10 in FIG. 1, a number of such seating sections being arranged side-by-side (FIG. 2) around the perimeter of an arena or a stadium outside the central playing/entertainment area. Each seating section comprises a plurality of longitudinal support beams 11 which, in the FIGS. 1 and 4 embodiments, are hingedly connected as at 12 to a permanent vertical wall 13 of the arena or stadium, and which are included downwardly toward floor 14. A support frame 15 supports the forward end of the beams above the surface of the floor, and a portable seating section 16, shown in phantom outline in FIG. 1, is typically arranged to smoothly transition between the forward end of section 10 and the floor.

Figure 3:
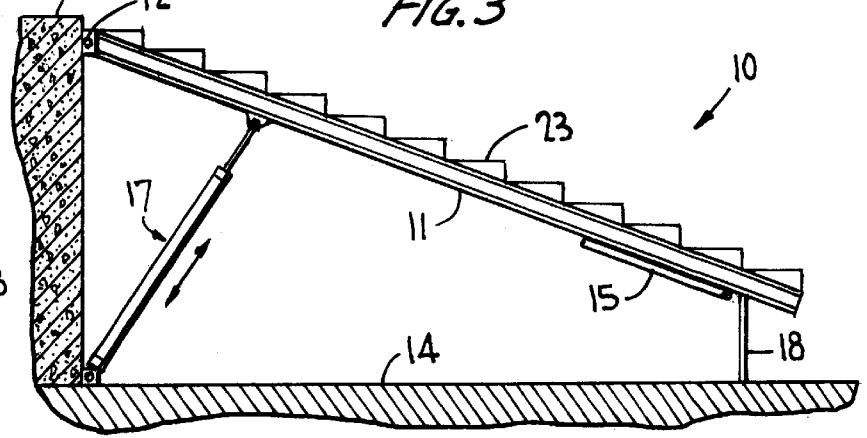
FIG. 3 is a view similar to FIG. 1 of the seating system of the invention at an adjustable high riser position.

A hydraulic or pneumatic piston/cylinder unit 17, or other force actuator, may be provided to facilitate lowering and elevating the forward end of the seating section in readiness for support by frame 15 (FIG. 1) or for support by a shorted frame 18 (FIG. 3). In the FIG. 3 high riser position support frame 15 may be stored in a folded position beneath beams 11 as shown.

As an alternative to actuator 17, a hydraulic piston/cylinder unit 19 (FIG. 4) affixed to floor 14 may be provided to shift support frame 15 into and out of its upstanding position for supporting the seating system in its low riser position shown in solid outline. In the high riser position of the seating system shown in phantom outline, the support frame 15 is gradually shifted inwardly toward unit 19 until frame support 18 becomes upstanding so as to support the forward end of the seating system as shown.

Figure 4:
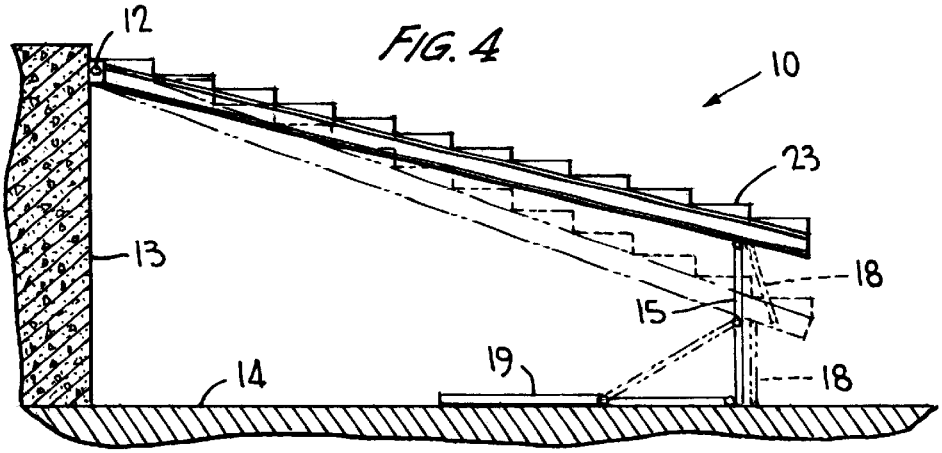
FIG. 4 is a view similar to FIG. 1 showing the sloping adjustment of the system being carried out by an alternative means.
Figure 5:
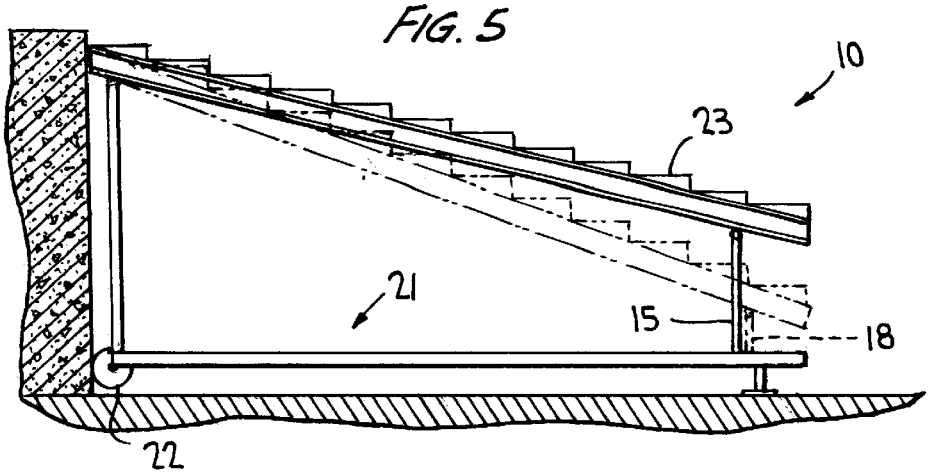
FIG. 5 is a view similar to FIG. 1 showing the sloping adjustment of the system being carried out by still another means.

A further alternative is illustrated in FIG. 5 in which the seating section is stored in its low riser position as shown in solid outline as it is supported on a transportable unit 21 and propped into its sloping position by support frame 15 which, unlike that of FIGS. 1 and 4, is fixed in its upstanding position. The seating section is transportable between its storage area and the arena/stadium perimeter location by a forklift truck arranged to push unit 21 while supporting this section as enabled by retractable wheels 22. Other seating sections may be stored on their respective units 21 in high riser positions, as shown in phantom outline in FIG. 5, and supported between storage and the perimeter location in the same way.

Figure 6:
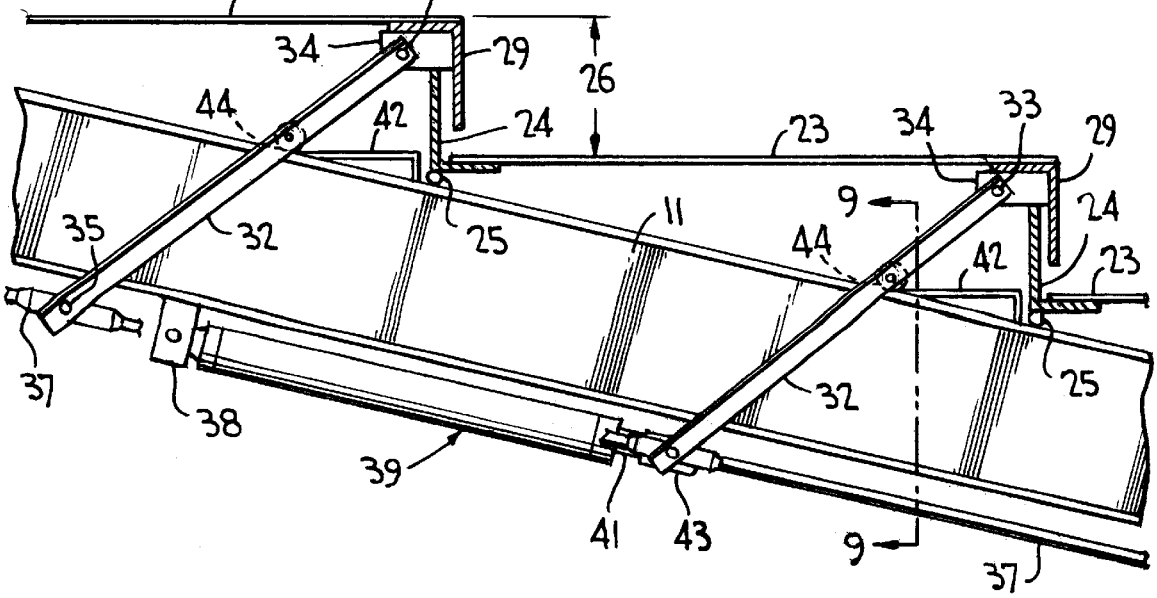
FIG. 6 is a detailed side elevational enlarged view of the seating system, partly in section, according to the invention in a low riser position.

Upper deck plates or treads 23 span support beams 11 of the respective seating sections and are welded or otherwise connected to respective angle beams 24 at the forward or rearward ends or in between, FIGS. 6 to 8 showing the treads connected to the angle beams along the rearward longitudinal ends thereof. The angle beams extend in the same transverse direction across support beams 11 of the respective seating section, and are pivotally connected thereto as at 25.

When a seating section is adjusted to its inclination of FIG. 1 or to its inclination of FIG. 3, low riser height 26 (FIG. 6) and high riser height 27 (FIG. 7) must be established as by maintaining treads 23 horizontal or substantially horizontal between forward and 15 rearward ends thereof. In accordance with an embodiment of the invention, the treads are pivotable to their low riser height 26 position by the provision of lever arms 32 shiftable between their angular position of FIG. 6 and their upright position of FIG. 7. The upper ends of the lever arms are pivotally connected as at 33 to brackets 34 affixed to forward angle beams 29 to which the forward ends of treads 23 are mounted. The forward ends of the treads slightly overlap the rearward ends of adjacent treads and, in the FIG. 6 low riser position, brackets 34 rest on angle beams 24 to support the treads substantially horizontally in their low riser position.

The opposite, lower ends of one of the lever arm pairs are pivotably connected as at 35 to elongated tie rods 37 lying substantially parallel to beams 11 and extending along one side of their respective support beams 11, as shown in FIGS. 8 and 9.

Mounted as at 38 to the underside of each beam 11 of each seating section is a hydraulic/pneumatic actuator 39 having an extendable and retractable piston rod 41 which is operated by pressure from a source (not shown) in some normal manner. The piston rod is connected to a transverse pin 43 to which the lower ends of those lever arms 32 are pivoted which are to be shifted by the extending and retracting piston rod. The shifting of such lever arms between their angular and upright positions of FIGS. 6 and 7 effects a uniform adjustment of the treads between their low riser position of FIG. 6 and their high riser position of FIG. 7.

Retraction of piston rod 41 of each of the actuators associated with the support beams 11 of the seating sections shifts tie rods 37 in a rearward direction of the seating section until brackets 34 bear against angle beams 24 in the adjusted position of FIG. 6.

Extension of each actuator piston rod shifts the lever arms to their upright position of FIG. 7 in which the arms support the forward ends of the treads on the upper flanges of beams 11 at spaced distances above angle beams 24 in the high riser position. For this purpose bent support plates 42 having upper substantially horizontal surfaces are affixed to beams 11. Rollers 44 span pairs of lever arms 32 as typically shown in FIG. 9 and bear against the upper surfaces of plates 42 for supporting the forward ends of the treads in their high riser position.

The rollers simply roll along the upper surfaces of plates 42 between the FIGS. 6 and 7 positions of the lever arms thereby acting as anti-friction bearings to effect a smooth transition between low and high riser positions of each seating section.

From the foregoing it can be seen that a simple and economical yet highly effective structure for a seating system has been devised which can be utilized in multiple stadium/arena configurations. The slope of the supporting understructure is adjustable and the treads are pivoted in such a manner that the riser heights are variable. This enables a single seating system to provide varying slopes and sight lines.

It can be seen that there are two steps in changing the riser height/sight lines of the system. The first is to change the slope of the understructure of the seating system, the other is to pivot the treads such that they are substantially level.

The size of each seating section can be constructed to meet almost any configuration desired. The width of a single section may be the full length of the playing sideline, several tapered sections arranged around an end zone area or multiple sections on wheels having a width such that they may be transported through the stadium/arena tunnel to a storage location. The length or depth of a single section may be as many rows as are desired.

Understructure beams 11 may be of steel, although wooden beams, open web trusses, etc. may be used without departing from the invention.

The typical pivot connection for the treads may be at the rearward ends thereof as shown. However, the pivotal joints of the treads may be located at the forward ends instead, or between the forward and rearward ends, within the scope of the invention. It may be desirable to locate such pivotal connections at the forward ends of portable sections which are to be stored elsewhere in order to ease transport and reduce storage height.

Actuators 17, 19 may be hydraulic piston/cylinder units, or may be in the form of linear actuators, chain hoists, cable winches, a forklift, etc.

The treads are pivoted about their pivotal connections upon shifting movements in the direction of support beams of the seating sections. When the tie rods are moved in a rearward direction, forward ends of the treads are lowered creating the low-riser position. At this position the forward ends of the treads are supported on adjacent treads at the rearward ends thereof as brackets 34 rest atop beams 24. When the tie rods are moved in a forward direction, the forward ends of the treads are raised creating the high riser position. The forward ends of the treads are supported by lever arms which are now shifted into an upstanding position from an angular position. The vertical load at the forward ends of the treads is transferred directly to the understructure beams via rollers on the arms bearing against bent support plates mounted the understructure beams.

Such tie rods that vary the riser heights may be shifted by a hydraulic actuator, a linear actuator, cables, threaded rods which rotate and cause an internally threaded sleeve to move up or down the main beam, etc., without departing from the invention.

The seating system may be constructed such that any desired combination of riser heights may be accommodated. A typical high riser position would be to have several rows of 16 inch risers at the rear of the seating arrangement decreasing to perhaps 12 inches at the front of the seating arrangement. These would then drop to around 10 inches at the rear and 7.50 inches at the front in the low riser position.

The treads may be of steel plates or light weight concrete shown as at 45. Of course, the treads could otherwise be of wood or synthetic material. Although the treads are designed so that they are level, they may be arranged to be slightly sloping in a forward direction as desired for easy cleaning.

A cross member 46 (FIG. 7) is welded between the pair of lever arms 32 for securing the arms together above roller 44. Thus only one tie rod 37 is required along one side of beam 11.

Since the tie rods are located along only one side, lever arms 32 can be cut off as to 47 (FIG. 7) just below rollers 44 on that side of beam 11 without the tie rod 37. The only full length location of both arms 32 is where they connect to piston rod 41 (FIGS. 8, 9).

Obviously, many other modifications and variations of the present invention are made possible in the light of the above teachings. It is therefore to be understood that within the scope of the appended claims the invention may be practiced otherwise than as specifically described.

What is claimed is:

1. A seating section of a seating system, comprising at least one pair of spaced longitudinal support beams and an upper occupant supporting deck surface mounted on the beams, the beams having an adjustable inclination to the horizontal so as to slope downwardly in a forward direction, the improvement wherein means are provided for adjusting the inclination of the beams between at least a first position and a second steeper position, said deck surface comprising transversely extending treads pivotably mounted to said beams along a first longitudinal end thereof, a second longitudinal end of each of said treads opposite said first end overlapping and being supported on an adjacent tread in the forward direction at a low riser height in said first position, lever arms for maintaining said treads substantially level irrespective of the inclination of said beams, said arms being movable between angular and upright positions and extending between each of said treads and said beams for supporting each said second end thereof on upper surfaces of said longitudinal beams spaced out of engagement with said adjacent tread to a high riser height in said second position which exceeds said low riser height.

2. The seating section according to claim 1, wherein said lever arms each have one end thereof pivoted to each said tread and have an opposite end pivotally connected to tie rods lying parallel to said beams.

3. The seating section according to claim 2, wherein pairs of said lever arms are provided for each said tread located on opposite sides of said beams.

4. The seating section according to claim 3, wherein said arm pairs are interconnected together by cross members.

5. The seating section according to claim 3, wherein said lever arms support each said second end of said treads by the provision of rollers mounted between said arm pairs in engagement with generally horizontal support plates mounted on said beams.

6. The seating section according to claim 3, wherein actuating means mounted on said beams are provided for moving said arm pairs between said angular and upright positions for pivoting said treads about said first longitudinal ends thereof.

* * * * *